United States Patent [19]

Yuhara

[11] Patent Number: 4,509,757

[45] Date of Patent: Apr. 9, 1985

[54] GOLF SWING DIAGNOSING DEVICE

[76] Inventor: Mitsuho Yuhara, 4-12-25 Kugayama, Suginami-ku, Tokyo, Japan

[21] Appl. No.: 501,629

[22] Filed: Jun. 7, 1983

[30] Foreign Application Priority Data

Jun. 18, 1982 [JP] Japan ..... 57-104016

[51] Int. Cl.[3] ..... A63B 69/36

[52] U.S. Cl. ..... 273/186 A; 273/186 D; 273/183 B; 273/191 R

[58] Field of Search ..... 273/186 D, 183 B, 26 R, 273/29 A, 191 B, 191 R, 192, 186 A

[56] References Cited

U.S. PATENT DOCUMENTS 2,995,376 8/1961 Leo ..... 273/186 D 3,311,377 3/1967 Holbus ..... 273/186 D 3,687,459 8/1972 Swords ..... 273/186 D

*Primary Examiner*—George J. Marlo

*Attorney, Agent, or Firm*—Holman & Stern

[57] ABSTRACT

A swing diagnosing device utilizes a recording plate having an indicating surface fitted to the front surface of a supporting plate attached to a base plate, and a rotary ball is borne by a cover fixed to the base plate. A shaft pipe projecting out of an arm is passed through this rotary ball, a supporting metal piece fixing the grip end of a golf club is attached to the lower end part of the arm, and a recording means is fitted to the tip of the shaft pipe at the upper end so that as the arm is operatively rotated with the golf swing the locus of the swing is recorded.

6 Claims, 6 Drawing Figures

GOLF SWING DIAGNOSING DEVICE

BACKGROUND OF THE INVENTION

1. Field of the Invention

This invention relates to a swing diagnosing device wherein the locus of a swing, particularly in golf, is diagnosed so that it can be corrected to be a proper swing form.

2. Description of the Prior Art

There have been already suggested various golf swing practicing machines. However, there is not swing diagnosing device wherein a series of swing loci from a backswing to a ball impact and follow-through in the swing are diagnosed.

BRIEF SUMMARY OF THE INVENTION

An object of the present invention is to record on a recording plate a series of swing loci from a backswing to a ball impact and follow-through.

Another object of the present invention is to removably fit recording plates recording swing loci so that loci of a plurality of swings can be respectively recorded.

A further object of the present invention is to diagnose loci of swings of one person recorded on the recording plate as compared with loci of typical swings of other people such as, for example, professional golf champions in order to correct the person's swing to be in correct swing form.

DETAILED DESCRIPTION

Figure 1:
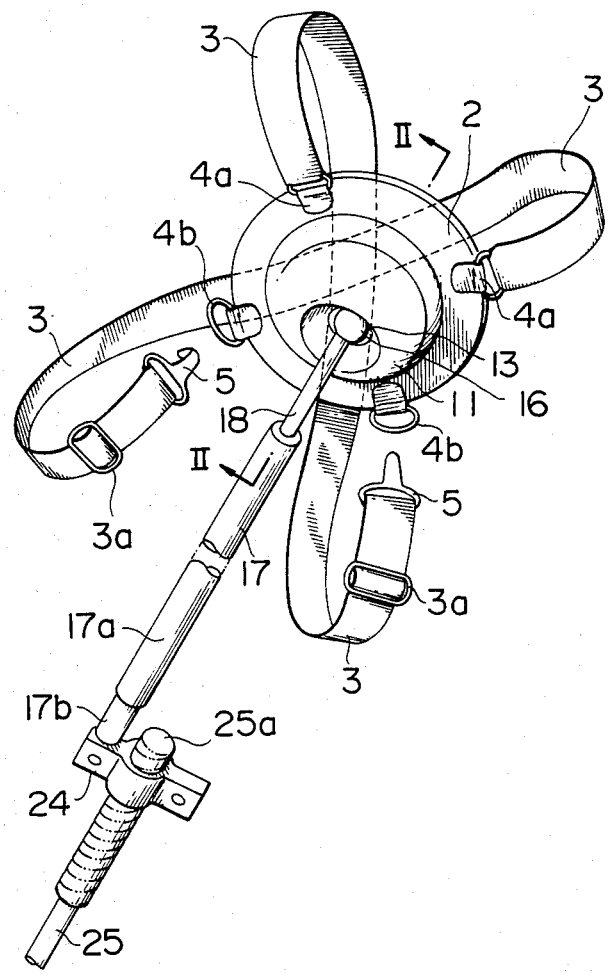
FIG. 1 is a general perspective view of a swing diagnosing device of the present invention.
Figure 4:
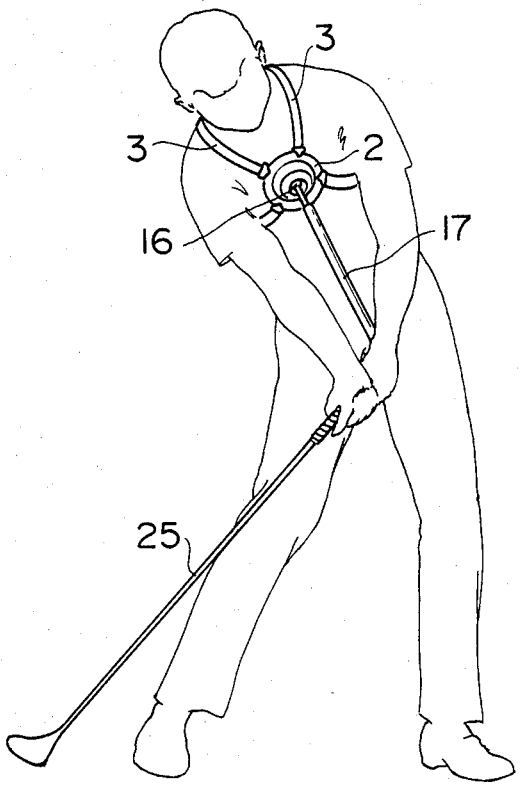
FIG. 4 is a schematic illustration of the manner of using the invention.

A band, or strap, 3, which is a holding means for supporting a base plate 1 on the breast of a body, is attached to the outer peripheral part 2 of the bae plate 1 formed to be disk-shaped. In FIG. 1 and FIG. 4, as shown, there are two bands 3 having respective buckles 3*a* for adjusting the lengths of the respective bands 3 which are attached at their respective ends to the right and left upper parts of the outer peripheral part 2 of the base plate 1 with fixing metal hooks 4*a*. The bands 3 are crossed with each other in the rear of the base plate 1 and are provided at their other ends with respective ssnap hooks 5. These snap hooks 5 can be removably attached respectively to receiving rings 4*b* attached to the right and left lower parts of the outer peripheral part 2.

Figure 2:
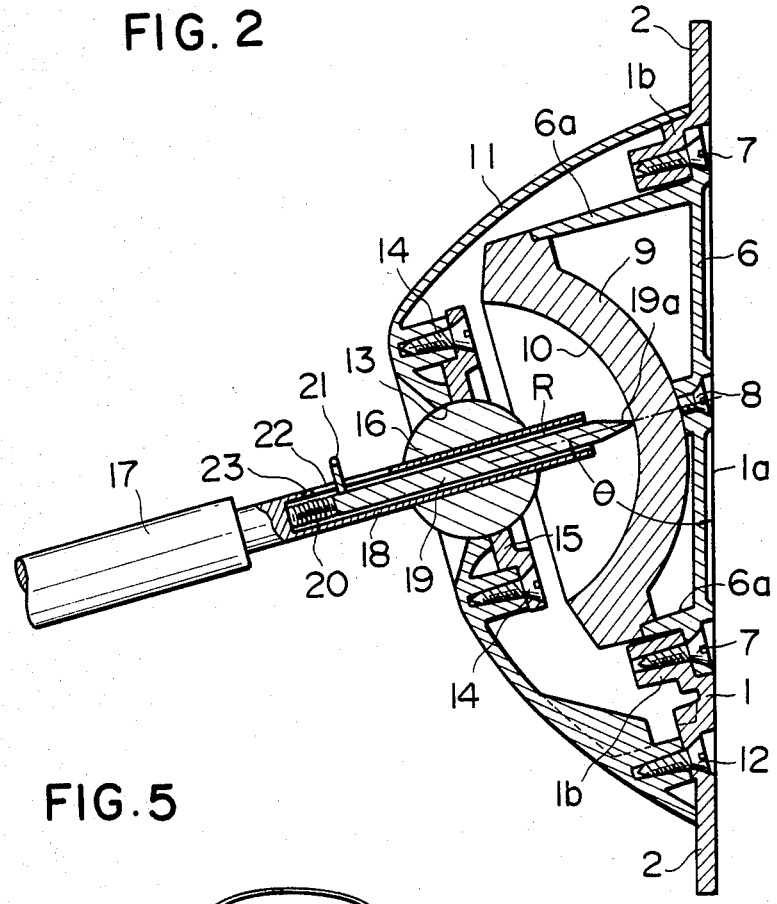
FIG. 2 is an enlarged cross-sectional view taken on line II—II in FIG. 1.

A supporting plate 6 is fitted in a hole 1*a* provided substantially in the central part of the base plate 1 and is fixed with screws 7 to the attaching parts 1*b* of the base plate 1. A removably fitted recording plate 9, supported with flanges 6*a* projecting from the outer peripheral part of the supporting plate 6 and fixed at its central part with a screw 8, is attached to the front surface of the supporting plate 6. An indicating surface 10 indicating loci of swings is provided further on the front surface of the recording plate 9 and is preferably formed as an arcuately concave surface as shown in FIG. 2 but may be plane. The recording plate 9 is inclined downwardly by an angle $\theta$ with the base plate 1. This angle is not particularly limited but is preferably 75 degrees in the inclination.

Figure 3:
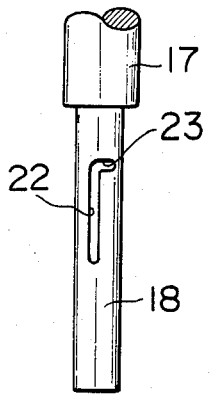
FIG. 3 is an enlarged elevational view showing a guide groove of a pipe shaft pipe.

A cover 11 is attached with a screw 12 to the base plate 1 so as to enclose the recording plate 9 and has an opening 13 made in the center position spaced outward from the recording plate 9. An auxiliary plate 15 is attached with screws 14 to the inside of the central portion of cover 11 and has an opening aligned with opening 13. The surface of these openings are segments of a spherical concave surface, and a rotary ball 16 is rotatably mounted in the part spherical surface formed by these openings when auxiliary plate 15 is assembled on cover 11. A pipe shaft 18 projecting out of an arm 17 is passed through and supported by the rotary ball 16. A recording means R is fitted within this shaft pipe 18 and as shown in FIG. 2. may be a writing tool 19, such as a ball pen, is inserted and fitted in pipe 18. The pen nib 19*a* of the writing tool 19 is pressed in contact with the surface 10 of the recording plate 9 by the spring force of a spring 20, and it can record the loci of the swing on the surface 10. Further, a lever 21 projects out of the writing tool 19 and is slidable along the guide groove 22 of the pipe shaft 18 as shown in FIG. 3 so that, when the lever 21 is locked in a stopper groove 23 at one end of this guide groove 22, the pen nib 19*a* will be withdrawn from the surface 10 enabling it to be locked.

The arm 17 consists of double telescoping inner and outer shafts 17*a* and 17*b* and can be adjustable in length by a stopping or clamping means (not illustrated). The shaft 17*b* is fitted at the lower end with a connecting metal piece, or mounting bracket, 24 to which the grip end 25*a* of a golf club 25 can be attached.

The operation of the swing diagnosing device of the present invention will now be explained. First of all, the bands 3 are fastened to the body, the base plate 1 is tightly positioned and fixed on the breast and then the grip end 25*a* of the golf club 25 is fitted to the connecting metal piece 24 at the lower end of the arm 17. Thereafter, the grip of the golf club 25 is gripped with both hands and, while telescoping the length of the arm 17, the distance between the body and wrist or the so-called triangle made by both arms and the wrists, is adjusted. After such preparation, a golf swing as is shown in FIG. 4 will be possible.

That is to say, in the present invention, with the swing of the golf club 25, the arm 17 will also rotate and, therefore, with the pen nib 19*a* of the writing tool 19 attached to the pipe shaft 18 of the arm 17, the loci of a series of swings from the back swing to the ball impact and follow through will be able to be written on the indicating surface 10 of the recording plate 9. After the golf swings, the recording plate 9 is removed, the loci of the swings inscribed on the indicating surface 10 are observed and the swings are diagnosed as to whether they are good or bad and are corrected to be in a correct swing form. If the lever 21 of the writing tool 19 is locked in the stopper groove 23 or the recording plate 9 is removed, golf swings will be able to be made in a free state.

Figure 5:
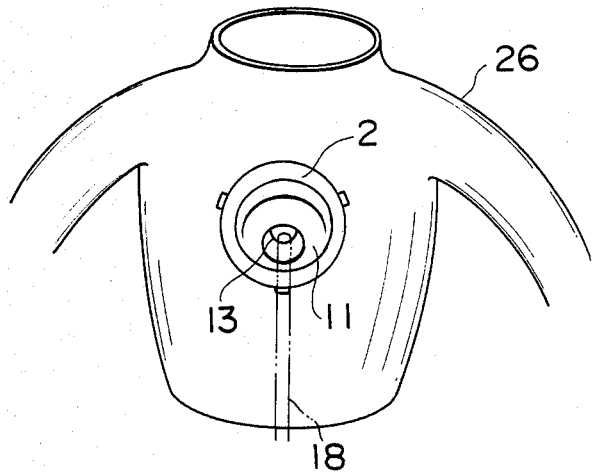
FIG. 5 is an elevational view of a base plate holding means.

Also, in the above mentioned embodiment, during the swing, the base plate 1 may float up. Therefore, if another band is fitted just below the outer peripheral part 2 of the base plate 1 and is fixed, for example, to the belt, the base plate 1 will be able to be more positively supported to the body. Further, if the base plate 1 is fitted directly to a jacket 26 as a base plate holding means as shown in FIG. 5, such trouble as removing the band each time will be omitted and the base plate 1 will not move unnecessarily.

Figure 6:
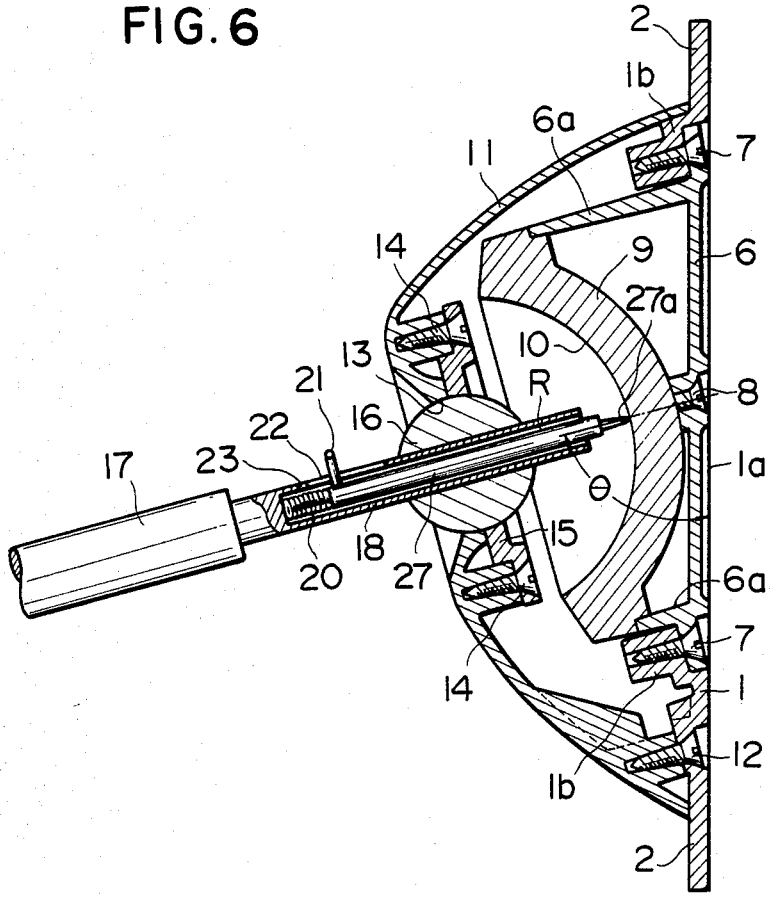
FIG. 6 is an enlarged cross-sectional view similar to FIG. 2 of another embodiment of the invention.

Furthermore, the recording means R, shown in FIG. 2 as a writing tool 19, may be a sharp tipped metal bar 27 as shown in FIG. 6.

The nip 27*a* of the sharp tipped metal bar 27 is pressed in contact with the surface 10 of the recording plate 9 by the spring force of a spring 20 and can leave the scratch mark of the loci of the swing on the surface 10.

Further, a lever 21 projecting out of the sharp tipped metal bar 27 is slidable along the guide groove 22 of the shaft pipe 18 as shown in FIG. 3 so that, when the lever 21 is locked in a stopper groove 23 at one end of this guide groove 22, the nip 27*a* will be withdrawn from the surface 10 enabling it to be locked.

In the explanation of the present invention, a golf swing diagnosing device has been described. However, the present invention can be extensively applied to such other swing diagnosing device as baseball bats and tennis rackets.

Therefore, when swings are made with the diagnosing device of the present invention fitted to the body, the loci of the swings will be able to be indicated on the recording plate by the recording means.

I claim:

1. A golf swing diagnosing device comprising:

a base plate;

means for removably supporting said base plate on a part of a person's body so that one side faces said body and the other front side faces outwardly therefrom;

a supporting plate having a front surface removably mounted on said base plate;

a recording plate removably mounted on the front surface of said supporting plate;

an indicating surface of said recording plate;

a cover mounted on said base plate enclosing said recording plate;

a front opening through said cover plate;

a rotary ball member rotatably mounted in said opening;

a pipe shaft extending through and fixedly mounted in said ball member having an inner end between said ball member and said indicating surface, and an outer end extending outwardly from said ball member;

a recording means mounted in said pipe shaft and extending from the inner end thereof in operative engagement with said indicating surface to mark a locus thereon when moved thereover; and an elongated telescoping arm attached to the outer end of said pipe shaft at one end and having a mounting bracket at the other end, said mounting bracket being adapted to removably connect the grip end of a golf club to said telescoping arm;

so that when the golf clug is swung by the person, the movement thereof is transmitted through said rotary ball member to record corresponding loci on said indicating surface by said recording means indicating the form of the swing.

2. A golf swing diagnosing device according to claim 1 wherein said recording means comprises a writing tool which can write drawings on said indicating surface.

3. A golf swing diagnosing device according to claim 1 wherein said recording means comprises a sharp tipped metal bar which will scratch a mark on said indicating surface.

4. A golf swing diagnosing device according to claim 1 wherein said means for supporting the base plate on a person's body comprises at least one adjustable strap attached to the base plate.

5. A golf seing diagnosing device according to claim 1 wherein said means for supporting the base plate on a person's body comprises a jacket to be worn by the person.

6. A golf swing diagnosing device as claimed in claim 1 and further comprising:

a means operatively mounted in said pipe shaft to resiliently urge said recording means into engagement with said indicating surface.

* * * * *